US008931367B2

(12) United States Patent
Himetani

(10) Patent No.: US 8,931,367 B2
(45) Date of Patent: Jan. 13, 2015

(54) OPERATING PEDAL DEVICE FOR VEHICLE

(75) Inventor: Yoshiro Himetani, Toyota (JP)

(73) Assignee: Toyoda Iron Works Co., Ltd., Toyota (JP)

( * ) Notice: Subject to any disclaimer, the term of this patent is extended or adjusted under 35 U.S.C. 154(b) by 974 days.

(21) Appl. No.: 12/656,089

(22) Filed: Jan. 15, 2010

(65) Prior Publication Data

US 2010/0180717 A1 Jul. 22, 2010

(30) Foreign Application Priority Data

Jan. 21, 2009 (JP) ..... 2009-011360

(51) Int. Cl.

| | |
|---|---|
| ***G05G 1/46*** | (2008.04) |
| ***G05G 1/30*** | (2008.04) |
| ***B60T 7/04*** | (2006.01) |
| ***G05G 1/50*** | (2008.04) |

(52) U.S. Cl.
CPC . *G05G 1/46* (2013.01); *G05G 1/506* (2013.01)
USPC ..... 74/512; 74/560

(58) Field of Classification Search
USPC ..... 74/512–514, 560, 562–562.5
IPC ..... G05G 1/44,1/445, 1/46, 1/36; B60T 7/06, B60T 7/04
See application file for complete search history.

(56) References Cited

U.S. PATENT DOCUMENTS

| | | | | |
|---|---|---|---|---|
| 2,884,803 | A * | 5/1959 | Willis | 74/512 |
| 2,936,867 | A * | 5/1960 | Perry | 74/513 |
| 5,996,440 | A * | 12/1999 | Nawata et al. | 74/512 |
| 6,076,422 | A * | 6/2000 | Tabata | 74/512 |
| 6,454,075 | B1 * | 9/2002 | Leuschke et al. | 74/512 |
| 6,752,038 | B2 | 6/2004 | Cordero | |
| 7,111,703 | B2 * | 9/2006 | Endo et al. | 74/512 |
| 2010/0147101 | A1 * | 6/2010 | Yamazaki | 74/512 |

FOREIGN PATENT DOCUMENTS

| | | | |
|---|---|---|---|
| DE | 42 30 395 | A1 | 3/1994 |
| DE | 10 2005 003 069 | A1 | 3/2006 |
| DE | 102007051564 | A1 * | 5/2008 |
| DE | 102007054975 | A1 * | 5/2009 |
| EP | 229350 | A2 * | 7/1987 |

(Continued)

OTHER PUBLICATIONS

European Search Report issued in European Patent Application No. 10 151 181.4 dated Oct. 21, 2011.

(Continued)

*Primary Examiner* — Daniel Yabut
(74) *Attorney, Agent, or Firm* — Oliff PLC

(57) ABSTRACT

A connecting opening portion is provided at the portion that is an outer circumferential portion of a hollow-structured operating pedal and is connected to connecting links inside the connecting opening portion, a reinforcing member having a U-shaped section is integrally weld-joined so as to open outward. End portions of the connecting links are inserted inside the reinforcing member, and are relatively pivotablly connected by a first link pin. Accordingly, the rigidity of the operating pedal is improved, and at the same time, the stress concentration is relieved, whereby buckling and deformation are suppressed. As a result, the plate thickness of the hollow-structured operating pedal can be kept small to minimize the weight thereof, and also, the width dimension of the operating pedal in the vehicle fore and aft direction can be reduced to achieve a compact size.

7 Claims, 6 Drawing Sheets

(56) References Cited

FOREIGN PATENT DOCUMENTS

| | | | | |
|---|---|---|---|---|
| EP | 1 260 419 | A1 | | 11/2002 |
| EP | 1440857 | A1 | * | 7/2004 |
| EP | 1510425 | A1 | * | 3/2005 |
| EP | 1950101 | A2 | * | 7/2008 |
| FR | 2 821 684 | A1 | | 9/2002 |
| JP | A-11-115699 | | | 4/1999 |
| JP | 2001047985 | A | * | 2/2001 |
| JP | A-2007-122610 | | | 5/2007 |
| WO | WO 2007/096079 | A1 | | 8/2007 |
| WO | WO 2008/102231 | A2 | | 8/2008 |

OTHER PUBLICATIONS

European Search Report issued in European Patent Application No. 10151181.4 dated Feb. 10, 2011.

* cited by examiner

OPERATING PEDAL DEVICE FOR VEHICLE

BACKGROUND OF THE INVENTION

1. Field of the Invention

The invention relates to an operating pedal device for a vehicle, such as a brake pedal device, and especially relates to a connecting structure of a pivotally connecting portion that transmits an operation force through a connecting pin.

2. Description of the Related Art

An operating pedal device for a vehicle including an operating pedal, a reaction force member, and a pivotally connecting portion has been widely used in a brake pedal device for a service brake or a parking brake, etc., for example. The operating pedal is mounted on a pedal support which is fixed to a vehicle pivotablly about the supporting axis and is depressed by a driver. The reaction force member is a member to which an operation force of the operating pedal is transmitted and on which a reaction force corresponding to the operation force is acted. The pivotally connecting portion is mounted between the reaction force member and the operating pedal or between a transmitting member that transmits the operation force to the reaction force member and the operating pedal. The pivotally connecting portion connects them relatively pivotablly about a connecting pin that is parallel to the supporting axis, and transmits the operation force through the connecting pin.

One example thereof is an apparatus disclosed in Patent Document 1 (JP-A-2007-122610). The operating pedal has a hollow structure, and the pivotally connecting portion is provided with connecting holes, which is in a pair of side plate parts located on the both sides in the vehicle width direction, formed in a straight line substantially parallel to the supporting axis. The connecting pin is inserted through both of the connecting holes of the side plate parts of the both sides, and the reaction force member is connected thereto through a clevis or the like.

Further, in Patent Document 2 (JP-A-11-115699), an intermediate lever which is mounted on the vehicular front side of the operating pedal pivotablly about an intermediate axis that is parallel to the supporting axis is disclosed. The intermediate lever is connected to the operating pedal through a connecting link, and is mechanically pivoted about the intermediate axis in accordance with the depressing operation of the operating pedal, thereby the operation force is transmitted to the reaction force member. In such a link-style operating pedal device, the connection portion between the connecting link and the operating pedal corresponds to the pivotally connecting portion, and the connecting link corresponds to the transmitting member.

However, according to the structure in which a connecting pin is inserted directly into connecting holes formed in a pair of side plate parts of an operating pedal having a hollow structure, an operation force (reaction force) intensively acts on edges of the connecting holes. This may result in buckling or deformation, and accordingly, there arises a necessity to increase the plate thickness of the operating pedal. In Patent Document 1, a collar is fixed to a connecting hole on one side plate part, whereby the workability upon the insertion of a connecting pin is improved and the strength is increased. However, in the side plate part on another side, problems of buckling and deformation still remain.

Against these problems, measures as shown in FIGS. 6A and 6B can be taken. FIGS. 6A and 6B are sectional views showing a pivotally connecting portion 112 where the operating pedal 100 is connected to a push rod 110 as a reaction force member. The operating pedal 100 is formed of a pair of half-divided bodies 102 and 104, as in the above Patent Document 1. The side edges of the pair of half-divided bodies 102 and 104, i.e., edges in the back and front or the top and bottom directions of the vehicle, are integrally weld-joined, and are relatively pivotablly connected to the push rod 110 through a clevis pin 106 and a clevis 108.

FIG. 6A shows an example in which the above-mentioned half-divided bodies 102 and 104 are provided with, burring holes 114 and 116 projecting inwardly as connecting holes, respectively. In this case, a reaction force acts intensively on the burring holes 114 and 116, and therefore, the problems of abrasion, buckling, and the like cannot be sufficiently solved. FIG. 6B shows an example in which a cylindrical collar 120 is mounted through both of the burring holes 114 and 116. In this case, the workability upon the insertion of the clevis pin 106 is improved, and abrasion is also alleviated. However, a reaction force acts intensively about the burring holes 114 and 116, and thus the possibility of buckling still remains.

Meanwhile, when a hollow-structured operating pedal is used in a link-style operating pedal device as disclosed in the above Patent Document 2, because of the existence of an intermediate lever on the vehicle front side, the size and shape of the operating pedal are limited. This makes it even more difficult to secure the rigidity and strength of a pivotally connecting portion. That is, for example, as shown in FIG. 1A, a space A that allows depressing operation of the operating pedal 14 has to be secured between an intermediate shaft 16 in front of the operating pedal 14 and the operating pedal 14, and also a space B for footwork has to be secured at the back of the operating pedal 14, i.e., on the drivers side. As a result, the width dimension of the operating pedal 14 in the fore and aft direction (horizontal direction in FIG. 1A) is limited.

The invention was accomplished against the above background. An object thereof is to increase the rigidity of a pivotally connecting portion to which a reaction force member or a transmitting member is connected with a connecting pin to thereby prevent buckling and deformation, while keeping the plate thickness of a hollow-structured operating pedal small to minimize the weight and size thereof.

SUMMARY OF THE INVENTION

The object indicated above may be achieved according to a first mode of the invention, which provides an operating pedal device for a vehicle, including: (a) an operating pedal mounted on a pedal support fixed to a vehicle pivotablly about a supporting axis and depressed by a driver; (b) a reaction force member transmitted an operation force of the operating pedal and acted a reaction force corresponding to the operation force; and (c) a pivotally connecting portion disposed between the reaction force member and the operating pedal or between a transmitting member transmitting the operation force to the reaction force member and the operating pedal, and connecting thereof relatively pivotablly about a connecting pin parallel to the supporting axis to transmit the operation force through the connecting pin, (d) the operating pedal having a substantially hollow structure as a whole and further including: a connecting opening portion formed at a portion that is an outer periphery portion of the operating pedal and is connected to the reaction force member or the transmitting member through the pivotally connecting portions, and formed with a pair of side plate parts of the operating pedal being spaced apart in a predetermined dimension in a direction parallel to the supporting axis; (e) a reinforcing member having a U-shaped section mounted inside the connecting opening portion, joined integrally to the operating pedal blocking the connecting opening portion in such a manner that an opening of the U-shaped section faces outward, and a pair of side plate parts of the U-shaped section overlap the pair of side plate parts of the connecting opening portion, and forming a closed section in the operating pedal; and (f) a pair of connecting holes formed in a straight line parallel to the supporting axis so as to pass through the pair of side plate parts of the reinforcing member and the pair of side plate parts of the connecting opening portion which are superposed at portions where the reinforcing member and the connecting opening portion are overlapped, and the connecting pin mounted through both of the pair of connecting holes formed on the side plate parts respectively, so that the operation force is transmitted between the operating pedal and the connecting pin at least through the reinforcing member and joining portions.

The object indicated above may be achieved according to the second mode of the invention, which provides the operating pedal device for a vehicle according to the first mode, wherein (a) the operating pedal is formed of a pair of half-divided bodies divided in the vehicle width direction and has a hollow structure formed by an integral joining, in an superposing manner, of plate-shaped flanges that are provided at outer circumferential portions of the pair of half-divided bodies and are parallel to each other; and (b) the pair of side plate parts of the connecting opening portion are formed of substantially parallel plate-like portions of the pair of half-divided bodies, which are provided with no flanges and spaced apart from each other.

The object indicated above may be achieved according to the third mode of the invention, which provides the operating pedal device for a vehicle according to the first or second mode, wherein an end portion of the reaction force member or the transmitting member on the side connected to the operating pedal is inserted inside the pair of side plate parts of the reinforcing member, and the connecting pin passes through the end portion and the pair of side plate parts, whereby the reaction force member or the transmitting member is pivotablly connected relative to the operating pedal relatively.

The object indicated above may be achieved according to the fourth mode of the invention, which provides the operating pedal device for a vehicle according to any one of the first to third modes, (a) further comprising an intermediate lever mounted on the pedal support in the vehicular front side of the operating pedal pivotablly about an intermediate axis parallel to the supporting axis, connected to the operating pedal through a connecting links and mechanically pivoted about the intermediate axis in accordance with the depressing operation of the operating pedal, thereby transmitting an operation force to the reaction force member, and wherein: (b) a connecting portion between the connecting links and the operating pedal serves as the pivotally connecting portion; the connecting link serves as the transmitting member; (c) the pair of connecting links are mounted so that the pair of connecting links put the intermediate lever between thereof; end portions of the connecting links on the operating pedal side are inserted inside the pair of side plate parts of the reinforcing member; and the connecting pin passes through the end portions, whereby the connecting links are pivotablly connected relative to the operating pedal relatively.

In such an operating pedal device for a vehicle, a connecting opening portion is provided at a portion that is an outer circumferential portion of an operating pedal having a substantially hollow structure as a whole and is connected to a reaction force member or a transmitting member through a pivotally connecting portion. A reinforcing member having a U-shaped section is mounted inside the connecting opening portion and is integrally joined thereto. The reinforcing member blocks the connecting opening portion, thereby forming a closed section in the operating pedal. Therefore, the rigidity that is comparable to the conventional level is secured by the closed section, and at the same time, owing to the existence of the reinforcing member, the rigidity and strength of the operating pedal can be further improved.

Moreover, in the portion where a pair of side plate parts of the reinforcing member and a pair of side plate parts of the connecting opening portion are overlapped, connecting holes are formed to pass through the overlapped side plate parts, and a connecting pin is mounted through both of the connecting holes of the side plate parts of both sides. Accordingly, the operation force (reaction force) is transmitted between the operating pedal and the connecting pin at least through the reinforcing member and joining portions, whereby local stress concentration on the operating pedal is prevented, and, as combined with the improvement in rigidity, buckling and deformation are suppressed. When the operation force is directly transmitted between the operating pedal and the connecting pin through the connecting holes of the operating pedal, the transmitting path is dispersed, whereby the stress concentration is further relieved.

As above, the rigidity of the operating pedal is improved, and at the same time, the stress concentration is relieved, whereby buckling and deformation are suppressed. Accordingly, the plate thickness of a hollow-structured operating pedal can be kept small to minimize the weight thereof. In addition, the width dimension of the operating pedal in the vehicle fore and aft direction can be reduced to achieve a compact size. This increases, for example, the degree of freedom of layout of a link-style operating pedal device having an intermediate lever.

The reinforcing member having a U-shaped section is mounted in such a manner that the opening thereof faces outward and that a pair of side plate parts overlap the pair of side plate parts of the connecting opening portion of the operating pedal. Accordingly, various joining methods such as arc welding, TIG welding, laser welding, resistance welding, caulking, and like can be employed, which enables an easy joining operation from the outside. Further, if necessary, a plurality of joining methods can be applied to firmly join them. In addition, the reaction force member or the transmitting member can be inserted inside the pair of side plate parts of the reinforcing member and thus be connected thereto, so as to reduce the dimension in the vehicle width direction, thereby achieving an operating pedal device with an even more compact size.

The second invention has an operating pedal with a structure in which flanges that provided at outer circumferential portions of a pair of half-divided bodies are integrally joined in an superposing manner. The pair of side plate parts of the connecting opening portion are formed of substantially parallel plate-like portions of the pair of half-divided bodies, which are not provided with the flanges and are spaced apart from each other. Accordingly, for example, when integrally joining the pair of half-divided bodies by weld-joining, etc., the reinforcing member can be continuously joined to the operating pedal. This facilitates assembly of the operating pedal including the reinforcing member, thereby the manufacturing cost can be reduced.

According to the third invention, the end portion of the reaction force member or the transmitting member on the side to be connected to the operating pedal is inserted inside the pair of side plate parts of the reinforcing member, and a connecting pin passes therethrough to thereby connect them relatively pivotablly. Accordingly, the dimension in the vehicle width direction can be reduced, thereby achieving an operating pedal device with an even more compact size.

According to the fourth invention related to a link-style operating pedal device, an intermediate lever is mounted on the vehicular front side of the operating pedal pivotablly about an intermediate axis parallel to the supporting axis. The intermediate lever is connected to the operating pedal through a connecting link, and is mechanically pivoted about the intermediate axis in accordance with the depressing operation of the operating pedal, thereby transmitting an operation force to the reaction force member. The width dimension of the operating pedal in the vehicle fore and aft direction can be reduced to achieve a compact size as mentioned above, and this accordingly increases the degree of freedom of layout of an operating pedal device including an intermediate lever. Accordingly, for example, the space A for allowing the depressing operation of an operating pedal and the space B for footwork (see FIG. 1A) can be secured relatively readily.

Connecting links, which are transmitting members, are mounted in a pair so as to put the intermediate lever between thereof. The end portions thereof on the operating pedal side are inserted inside the pair of side plate parts of the reinforcing member, and a connecting pin passes therethrough to thereby connect them relatively pivotablly. Accordingly, as in the third invention, the dimension in the vehicle width direction can be smaller, thereby achieving an operating pedal device with an even more compact size.

BRIEF DESCRIPTION OF THE DRAWINGS

FIG. 1A is a left side view, and FIG. 1B is a front view.

FIG. 4 shows a side view corresponding to FIG. 1A.

FIG. 5 shows a side view corresponding to FIG. 1A.

DETAILED DESCRIPTION OF THE PREFERRED EMBODIMENTS

Figure 1A:
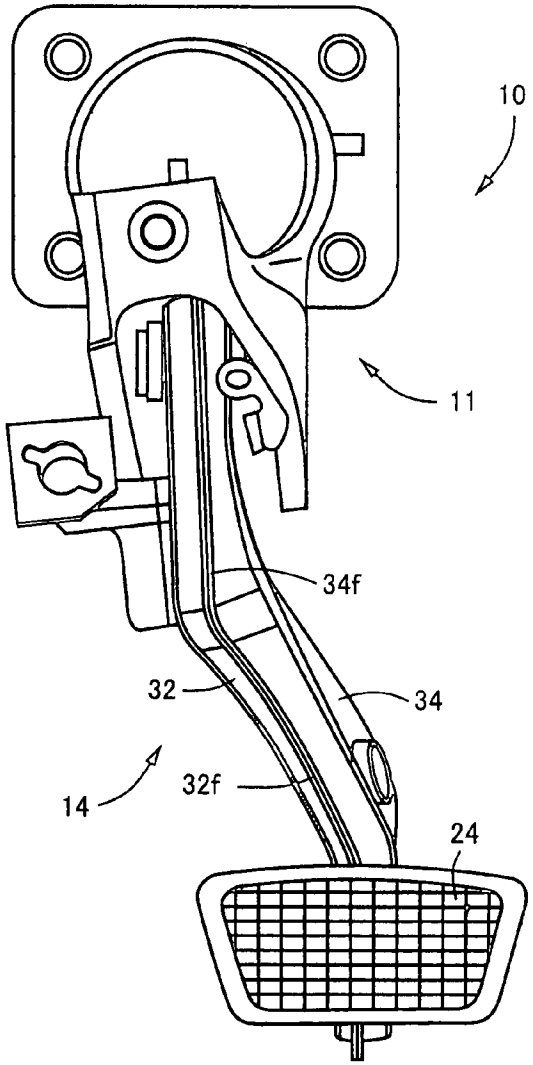
FIGS. 1A and 1B are diagrams showing a brake pedal device for a service brake of a vehicle according to the present invention.

The operating pedal device for a vehicle of the invention is suitable for application to an operating pedal device for a service brake or an parking brake, on which a relatively large reaction force acts. However, applications to an accelerator pedal, a clutch pedal, and other operating pedal devices for a vehicle are also possible. Examples of reaction force members include a brake master cylinder and a push rod, to which a reaction force corresponding to an output is mechanically applied. In electric operating pedal devices that electrically detect a depressing stroke of an operating pedal or the like to control the braking force or the like, the reaction member may be one to which a predetermined reaction force is applied in accordance with a depressing stroke by a simulation apparatus having a spring or like biasing means.

The reaction force member may be directly connected to an operating pedal through a pivotally connecting portion, and may also be connected to an operating pedal through an intermediate lever, a connecting link, and the like, or a plurality of intermediate levers. The invention is suitably applied in the case where, as in the fourth invention, an intermediate lever is mounted before (on the vehicular front side of) an operating pedal. However, it may also be applied to a link-style operating pedal device, in which an intermediate lever is mounted to an upper part on the vehicular rear side of an operating pedal.

The operating pedal having a hollow structure may be formed of a single steel sheet that has been bending-processed into a cylindrical shape, a square pipe, or the like. It may also be formed of a pair of half-divided bodies having a hat-like section made of a steel plate, etc., and which have been integrally joined by welding or the like in an superposing mariner so that they face each other to allow mutual contact between the outer circumferential flanges. Thus, various embodiments are possible. As used herein, a hollow structure does not necessarily have be a structure in which the entire periphery except for the connecting opening portion is hermetically sealed into a pouch shape, and may be partially open.

In the boundary between the pouch-like portion (closed portion) formed by the integral joining of the flanges in a superposing manner and the connecting opening portion, stress concentration may occur due to the difference in rigidity between them. Accordingly, the reinforcing member that is integrally joined to the connecting opening portion is preferably formed to overlap the pouch-like portion. The plate thickness of the reinforcing member may be substantially the same as the plate thickness of an operating pedal, and may also be less or more than this. The thickness is suitably determined depending on the material, required strength, and the like.

As a joining method to join an operating pedal and a reinforcing member, welding methods such as arc welding, TIG welding, laser welding, resistance welding, and the like are suitably used, for example. Alternatively, caulking or another joining method may also be employed. With respect to a connecting pin that is provided to pass through both of the connecting holes of the side plate parts of both sides, integral joining the connecting pin and the operating pedal can be easily performed by weld-joining. However, caulking, screw engagement, or another fixing method may also be employed. The connecting pin may be mounted relatively pivotablly to both the operating pedal and the transmitting member or the reaction force member, or may also be fixed to either of these relatively non-pivotablly.

An operation force applied to the operating pedal is transmitted between the operating pedal and the connecting pin at least through the reinforcing member and the joining portion, and, for example, a play may be formed between the connecting holes of the operating pedal and the connecting pin. However, in order to provide direct transmitting of an operation force between the operating pedal and the connecting pin, the connecting holes of the operating pedal and those of the reinforcing member preferably have the same diameter, so that a connecting pin can be engaged with both the connecting holes.

According to the third invention, the end portion of the transmitting member or the reaction force member on the operating pedal side is inserted inside the pair of side plate parts of the reinforcing member, and a connecting pin passes therethrough to thereby connect them relatively pivotablly to the operating pedal. However, in the implementation of the first invention and the second invention, the transmitting member or the reaction force member may also be connected to the outside of the pair of side plate parts of the connecting opening portion of the operating pedal. Also when a pair of connecting links are connected as a transmitting member to the operating pedal as in the fourth invention, such connecting links can be connected to the outside of the connecting opening portion of the operating pedal.

EXAMPLES

Hereafter, examples of the invention are described in detail with reference to the drawings.

Figure 1B:
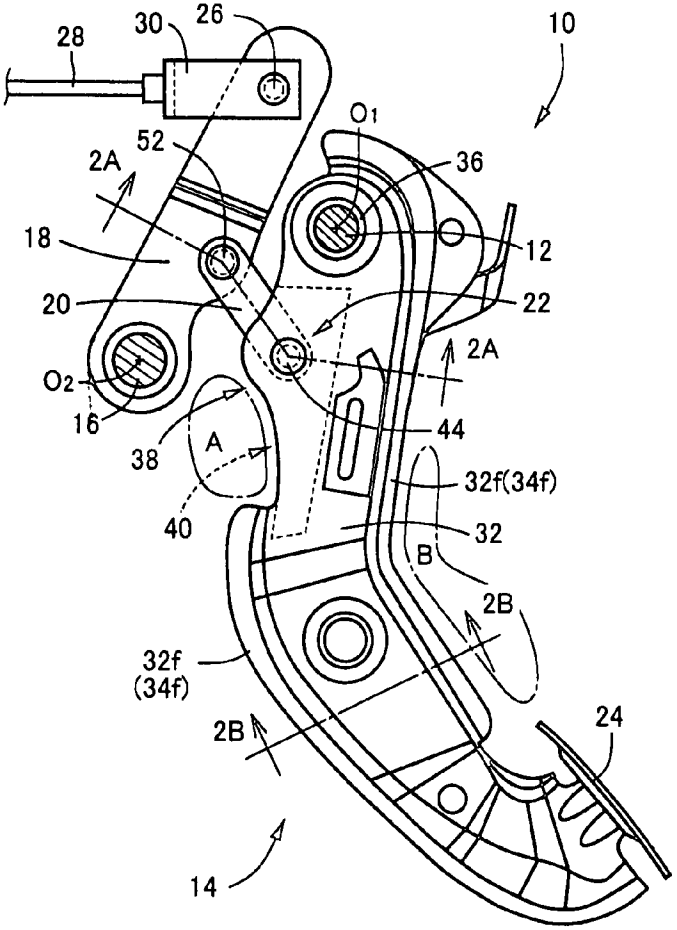

FIGS. 1A and 1B are diagrams showing a brake pedal device 10 for a service brake of a vehicle according to one embodiment of the invention. FIG. 1A is a left side view, and FIG. 1B is a front view. The brake pedal device 10 is a link-style operating pedal device including an operating pedal 14, an intermediate lever 18, and connecting links 20. The operating pedal 14 is mounted on a pedal support 11 integrally fixed to a vehicle pivotablly about an axis $O_1$ of a substantially horizontal supporting shaft 12. The intermediate lever 18 is mounted before the operating pedal 14 pivotablly about the axis $O_2$ of an intermediate shaft 16 that is substantially parallel to the axis $O_1$ of the supporting shaft 12. Connecting links 20 are mounted to span both of the operating pedal 14 and the intermediate lever 18.

When a pedal sheet 24 provided at the lower end of the operating pedal 14 is depressed by a driver, the operating pedal 14 is pivoted in the clockwise direction about the supporting shaft 12 in FIG. 1A. In accordance with the depressing operation of the operating pedal 14, through the connecting links 20, the intermediate lever 18 is mechanically pivoted in the counterclockwise direction about the intermediate shaft 16.

A push rod 28 of a brake master cylinder is connected to the upper end portion of the intermediate lever 18 through a clevis 30 relatively pivotablly about the axis of a clevis pin 26 that is substantially parallel to the intermediate shaft 16. The push rod 28 is mechanically pressed leftward in FIG. 1A with the pivoting of the intermediate lever 18, whereby a braking oil pressure is generated corresponding to the depressing operation force of the operating pedal 14, and the reaction force thereof acts on the push rod 28. The push rod 28 is biased in a direction projecting from the brake master cylinder. When the depressing operation of the pedal sheet 24 is released, the biasing force allows the intermediate lever 18 to pivot reversely in the clockwise about the axis $O_2$ of the intermediate shaft 16. At the same time, through the connecting links 20, the operating pedal 14 is pivoted about the axis $O_1$ of the supporting shaft 16 reversely in the counterclockwise direction, and is maintained in the original position shown in FIGS. 1A and 1B.

In this example, the connecting portion between the operating pedal 14 and the connecting links 20 corresponds to the pivotally connecting portion 22 according to the invention. A connecting link 20 corresponds to a transmitting member, and the push rod 28 corresponds to a reaction force member. Further, the axis $O_1$ of the supporting shaft 12 corresponds to a supporting axis, and the axis $O_2$ of the intermediate shaft 16 corresponds to an intermediate axis.

Figure 2A:
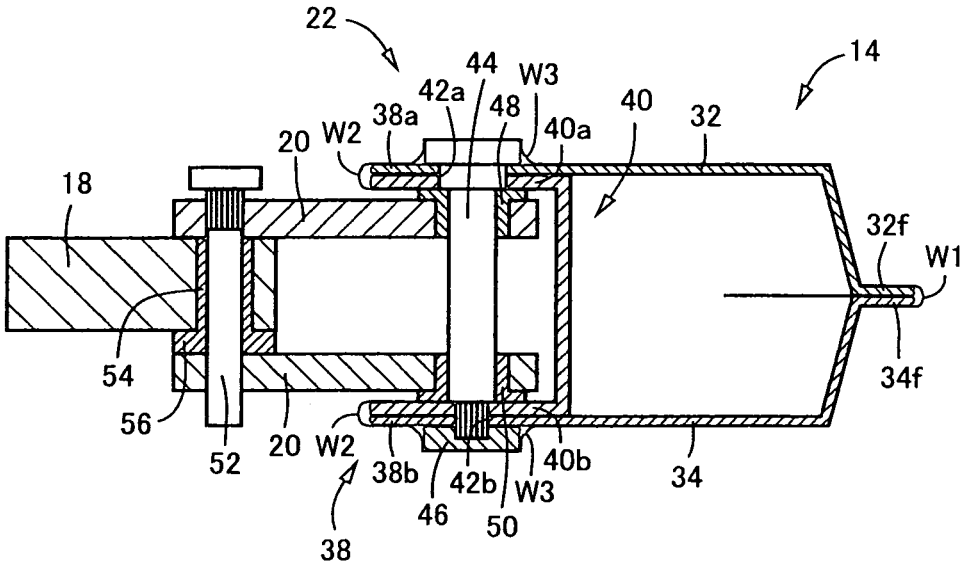
FIGS. 2A and 2B are enlarged views showing the 2A-2A section and the 2B-2B section defined in FIG. 1A, respectively.
Figure 2B:
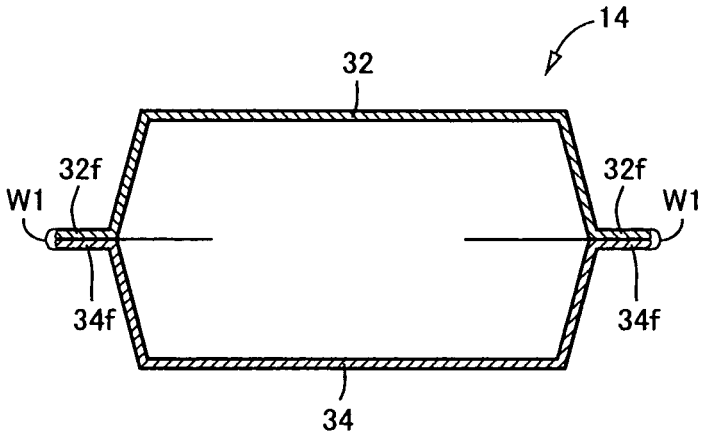

The operating pedal 14 has a substantially hollow structure as a whole, and is formed of a pair of half-divided bodies 32 and 34 having a shape divided in the vehicle width direction. FIG. 2A is an enlarged view of the 2A-2A section defined in FIG. 1A. In FIG. 2B that is an enlarged view of the 2B-2B section defined in FIG. 1A, the 2B-2B sectional portion has a pouch shape with the both sides being completely blocked. The half-divided bodies 32 and 34 are formed by press-bending or press-drawing a steel sheet. Each of them has a hat-shaped section (shallow convex shape). The structure of the half-divided bodies 32 and 34 are as follows. In such a way that openings of the hat-shaped sections face each other, and in an superposing manner so that the outer circumferential plate-shaped flanges 32*f* and 34*f* parallel to each other are in close contact with each other, the outer edges of the flanges 32*f* and 34*f*, i.e., the edges located in the fore and aft direction or the up and down (vertical) direction of a vehicle, are integrally weld-joined by arc welding, such as TIG welding. The first weld-joined portion W1 shown in FIG. 2A, FIG. 2B, and FIG. 3 represents the weld-joined portions of flanges 32*f* and 34*f* A portion of the pair of half-divided bodies 32 and 34, that is supported by the supporting shaft 12 has a through hole formed therein, and a cylindrical boss 36 (see FIGS. 1A and 1B) is integrally fixed by welding or the like through both the half-divided bodies 32 and 34.

Figure 3:
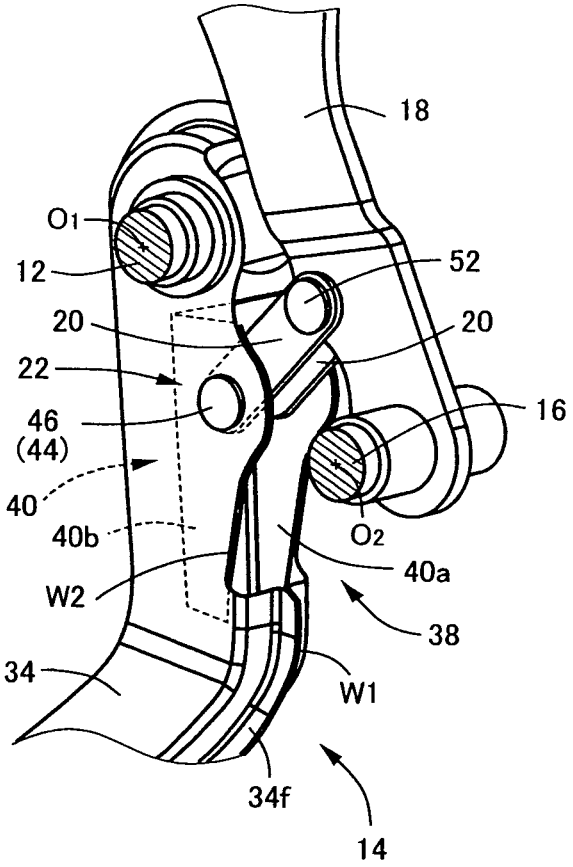
FIG. 3 is a perspective view of the vicinity of a pivotally connecting portion of the brake pedal device of FIGS. 1A and 1B, as viewed from the vehicular front side.

As evident from the perspective views shown in FIG. 2A and FIG. 3, the flanges 32*f* and 34*f* are not provided at a portion. that is an outer periphery portion of the pair of half-divided bodies 32 and 34 and is connected to a connecting link 20 through a pivotally connecting portion 22, i.e., a portion on the vehicular front side that is positioned on a slightly lower side of the supporting shaft 12 and where a biasing load is applied due to the reaction force of the connecting link 20. In the portion with no flanges, the half-divided bodies 32 and 34 are positioned apart in a predetermined dimension in the direction parallel to the axis $O_1$ (the vertical direction in FIG. 2A) and are in the shape of plates that are substantially perpendicular to the axis $O_1$ and parallel to each other. Further, a connecting opening portion 38 that is open toward the vehicular front side thereof is provided thereto. The plate-like portions of the pair of half-divided bodies 32 and 34 forming the connecting opening portion 38 correspond to a pair of side plate parts 38*a* and 38*b* of the connecting opening portion 38, which are parallel to each other.

Inside the connecting opening portion 38, a reinforcing member 40 having a U-shaped section is mounted so that the opening of the U-shaped section faces outward, and the pair of side plate parts 40*a* and 40*b*, which form the U-shape and are parallel to each other, overlap the pair of side plate parts 38*a* and 38*b* of the connecting opening portion 38 respectively.

The opening edges of the side plate parts 40*a* and 40*b* of the reinforcing member 40 have the similar shape to the opening edge of the connecting opening portion 38, and, in the state that they are matched with the edges of the pair of side plate parts 38*a* and 38*b* of the connecting opening portion 38, the edges are integrally weld-joined by arc welding, such as TIG welding. Since the reinforcing member 40 is integrally weld-joined to the connecting opening portion 38 in this manner, the connecting opening portion 38 is blocked, thereby a hollow closed section of the operating pedal 14 is formed.

The second weld-joined portion W2 shown in FIG. 2A and FIG. 3 represents the weld-joined portion between the reinforcing member 40 and the opening edge of the connecting opening portion 38. If necessary, resistance welding (spot welding, etc.) may also be additionally applied to the portion where the side plate parts 38*a* and 40*a* are overlapped and also to the portion where the side plate parts 38*b* and 40*b* are overlapped.

Further, as evident from FIG. 1A and FIG. 3, the reinforcing member 40 is provided so that the lower end portion thereof overlaps in a predetermined dimension the first weld-joined portion W1 where the pair of flanges 32*f* and 34*f* are integrally joined in a foreside of the operating pedal 14 (the left side in FIG. 1A). Since the reinforcing member 40 is weld-fixed in this manner, the rigidity and strength of the pivotally connecting portion 22 are increased. The plate thickness of the reinforcing member 40 is suitably set in consideration of the material thereof, required strength, and the like. In this example, metal plate with a thickness greater than the plate thickness of the half-divided bodies 32 and 34 that form the operating pedal 14 is used.

At the portions where the pair of side plate parts 40*a* and 40*b* of the above reinforcing member 40 and the pair of side plate parts 38*a* and 38*b* of the connecting opening portion 38 of the operating pedal 14 overlap, connecting holes 42*a* and 42*b* are formed in a straight line parallel to the axis $O_1$ so as to pass through the overlapping side plate parts 38*a* and 40*a* and side plate parts 38*b* and 40*b*, respectively. Further, a first link pin 44 that connects the connecting links 20 to the operating pedal 14 is mounted through both the connecting hole 42*a* of the side plate parts 38*a* and 40*a* on one side and the connecting hole 42*b* of the side plate parts 38*b* and 40*b* on the other side. The connecting hole 42*a* of the side plate parts 38*a* and 40*a* and the connecting hole 42*b* of the side plate parts 38*b* and 40*b* are each formed to have a constant diameter, so that both the side plate parts 38*a* and 40*a* and the side plate parts 38*b* and 40*b* can be engaged with the first link pin 44. Accordingly, the operation force (reaction force) is directly transmitted between the operating pedal 14 and the first link pin 44, and at the same time, the operation force is indirectly transmitted between the operating pedal 14 and the first link pin 44 through the reinforcing member 40 and the second weld-joined portion W2.

A serration is provided at the front end portion of the first link pin 44, and the first link pin 44 is press-fixed into a bearing block 46 to retain the pin at the serration. The head portion of the first link pin 44 and the bearing block 46 are integrally weld-joined by arc welding or the like to the outer sides of the pair of side plate parts 38*a* and 38*b* of the connecting opening portion 38, respectively. The third weld-joined portion W3 shown in FIG. 2A represents a weld-joined portion between the head portion of the first link pin 44 and the side plate part 38*a*, and also represents a weld-joined portion between the bearing block 46 and the side plate part 38*b*. The operation force is directly transmitted between the operating pedal 14 and the first link pin 44 also through the third weld-joined portion W3.

The pair of connecting links 20 are mounted parallel to each other so that the intermediate lever 18 is put between the pair of the connecting links 20. One end portions of the connecting links 20 on the operating pedal 14 side are inserted inside the pair of side plate parts 40*a* and 40*b* of the reinforcing member 40, and the first link pin 44 passes through the one end portions, whereby the connecting links 20 are connected relatively pivotablly to the operating pedal 14. Cylindrical bushes 48 and 50 are disposed between the pair of connecting links 20 and the first link pin 44, respectively. Both the bushes 48 and 50 have integrally formed thereon collars in the shape of outward flanges, and the collars are disposed between the connecting links 20 and the pair of side plate parts 40*a* and 40*b* of the reinforcing member 40. The first link pin 44 corresponds to a connecting pin of the pivotally connecting portion 22 that connects the operating pedal 14 and the connecting links 20 which serve as a transmitting member relatively pivotablly.

The other end portions of the pair of connecting links 20, i.e., the end portions on the intermediate lever 18 sides, are connected to the intermediate lever 18 relatively pivotablly through the second link pin 52 that is parallel to the first link pin 44. A serration is provided near the head portion of the second link pin 52, and the second link pin 52 is integrally press-fixed to one connecting link 20 located on the upper side in FIG. 2A at the serration. A cylindrical bush 54 is disposed between the intermediate lever 18 and the second link pin 52. At one end portion of the bush 54 projecting from the intermediate lever 18, a boss 56 is integrally provided to fill the space between a connecting link 20 and the intermediate lever 18, so as to prevent rattling between the intermediate lever 18 and the pair of connecting links 20, and the like.

As described above, in the brake pedal device 10 of this example, the connecting opening portion 38 is provided at the portion that is a part of the outer circumferential portion of the operating pedal 14 having a substantially hollow structure as a whole, and is connected to the connecting links 20 through the pivotally connecting portion 22. The reinforcing member 40 having a U-shaped section is integrally joined inside the connecting opening portion 38 to block the connecting opening portion 38, thereby forming a closed section of the operating pedal 14. Accordingly, the closed section secures the rigidity that is comparable to the conventional level, and at the same time, owing to the existence of the reinforcing member 40, rigidity and strength can be further improved.

Further, at the portions where the pair of side plate parts 40*a* and 40*b* of the above reinforcing member 40 and the pair of side plate parts 38*a* and 38*b* of the connecting opening portion 38 are overlapped, connecting holes 42*a* and 42*b* are formed so as to pass through the overlapping side plate parts 38*a* and 40*a* on one side and the overlapping side plate parts 38*b* and 40*b* on the other side, respectively. The first link pin 44 is provided to pass through both of these connecting holes 42*a* and 42*b*. Further, the operation force is directly transmitted between the operating pedal 14 and the first link pin 44, and at the same time, the operation force is indirectly transmitted between the operating pedal 14 and the first link pin 44 through the reinforcing member 40 and the second weld-joined portion W2. Accordingly, the transmitting path of the operation force is dispersed, whereby local stress concentration on the operating pedal 14 is prevented, and, as combined with the improvement in the rigidity or strength of the connecting opening portion 38, the buckling and deformation of the operating pedal 14 are suppressed.

In addition, in this example, the operation force is directly transmitted between the operating pedal 14 and the first link pin 44 also through the third weld-joined portion W3 in which the head portion of the first link pin 44 and the bearing block 46 are integrally weld-joined to the pair of side plate parts 38*a* and 38*b* of the connecting opening portion 38, respectively. Accordingly, the transmission of the operation force is further dispersed, and thus the buckling and deformation of the operating pedal 14 are prevented even more effectively.

Further, in the boundary portion between the first weld-joined portion W1 where the pair of flanges 32*f* and 34*f* are integrally joined in the foreside of the operating pedal 14 and the connecting opening portion 38 where the first weld-joined portion W1 does not exist, stress concentration may occur due to the difference in rigidity between them. However, in this example, the reinforcing member 40 is mounted on the connecting opening portion 38 in such a manner that the lower end portion of the reinforcing member 40 is overlapped the first weld-joined portion W1 in a predetermined dimension. Accordingly, the stress concentration on the boundary portion is suppressed, and thus buckling and deformation of the operating pedal 14 are prevented even more appropriately.

Thus, the rigidity of the operating pedal 14 is improved, and at the same time, the stress concentration is relieved, whereby buckling and deformation are suppressed. Accordingly, the plate thickness of a hollow-structured operating pedal 14 can be kept small to minimize the weight thereof, and also, the width dimension of the operating pedal 14 in the vehicle fore and aft direction can be reduced to achieve a compact size. In the link-style brake pedal device 10 of this example, the intermediate lever 18 is mounted on the vehicular front side of the operating pedal 14 pivotablly about the axis $O_2$ of the intermediate shaft 16 that is parallel to the axis $O_1$ of the supporting shaft 12 and the intermediate lever 18 is connected to the operating pedal 14 through the connecting links 20. In this link-style brake pedal device 10, the above structure increases the degree of freedom of layout of the brake pedal device 10 including the intermediate lever 18, and accordingly, the space A for allowing the depressing operation of an operating pedal 14 and the space B for footwork (see FIG. 1A) can be secured relatively readily.

Figure 4:
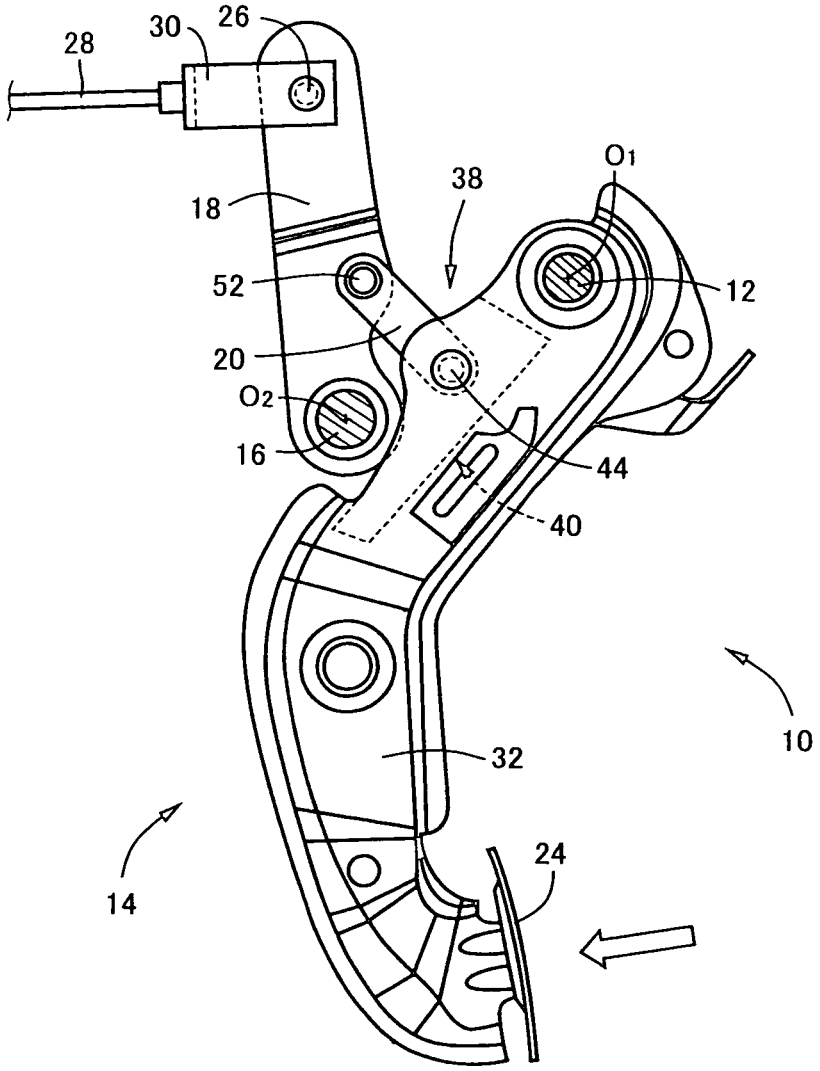
FIG. 4 is a left side view of an operating pedal of the brake pedal device of FIG. 1, as depressed.

Further, in this example, the pair of connecting link 20 mounted so that the intermediate lever 18 is put therebetween are inserted inside the connecting opening portion 38, and are connected to the operating pedal 14 through the first link pin 44 relatively pivotablly. Accordingly, when the operating pedal 14 is depressed and is pivoted toward the vehicle front side, the intermediate lever 18 can enter inside the connecting opening portion 38, as shown in FIG. 4. The supporting shaft 12 and the intermediate shaft 16 can thus be placed close to each other in vehicle fore and aft direction, accordingly.

That is, in this example, at a position lower than the supporting shaft 12, and in the state where the operating pedal 14 is maintained in the original position shown in FIGS. 1A and 1B, the intermediate shaft 16 is provided before the pivotally connecting portion 22 and the intermediate lever 18 extending upwards is mounted pivotablly about the intermediate shaft 16. Accordingly, the space A has to be established to avoid interference between the lower end portion of the intermediate lever 18 and the operating pedal 14 when the operating pedal 14 is depressed to pivot toward the vehicle front side. However, because the intermediate lever 18 is allowed to enter inside the connecting opening portion 38, the space A can be made small to further reduce the dimension of the brake pedal device 10 in the vehicle fore and aft direction, whereby the mountability on a vehicle is further improved.

Further, the pair of connecting links 20 which are mounted on both sides of the intermediate lever 18, are inserted inside the connecting opening portion 38, and are connected to the operating pedal 14 relatively pivotablly through the first link pin 44. Accordingly, in comparison with the case where the connecting links 20 are connected to the outside of the connecting opening portion 38, i.e., the outside of the hollow operating pedal 14, the dimension of the operating pedal 14 in the vehicle width direction can be reduced, thereby a brake pedal device 10 is made to be even more compact.

The reinforcing member 40 having a U-shaped section is mounted in such a manner that the opening thereof faces outward and that the pair of side plate parts 40*a* and 40*b* overlap the pair of side plate parts 38*a* and 38*b* of the connecting opening portion 38 of the operating pedal 14. Accordingly, various joining methods such as arc welding, TIG welding, laser welding, resistance welding, caulking, and like can be employed for the joining of them, which enables an easy joining operation from the outside. Further, if necessary, a plurality of joining methods can be applied to firmly join them.

Further, the operating pedal 14 of this example has a hollow structure formed by the integral joining, in an superposing manner, of the plate-shaped flanges 32*f* and 34*f* that are provided at outer circumferential portions of the pair of half-divided bodies 32 and 34 divided in the vehicle width direction. The pair of side plate parts 38*a* and 38*b* of the connecting opening portion 38 are formed of substantially parallel plate-like portions of the pair of half-divided bodies 32 and 34, which are not provided with the flanges 32*f* and 34*f* and spaced apart from each other. Accordingly, when the flanges 32*f* and 34*f* of the pair of half-divided bodies 32 and 34 are integrally weld-joined at the first weld-joined portion W1 by arc welding or the like, i.e. weld joining at the first weld-joined portion W1 is performed, weld-joining at the second weld-joined portion W2 can be continuously performed to integrally join the reinforcing member 40 to the operating pedal 14. This facilitates assembly of the operating pedal 14 including the reinforcing member 40, thereby reducing the manufacturing cost.

Figure 5:
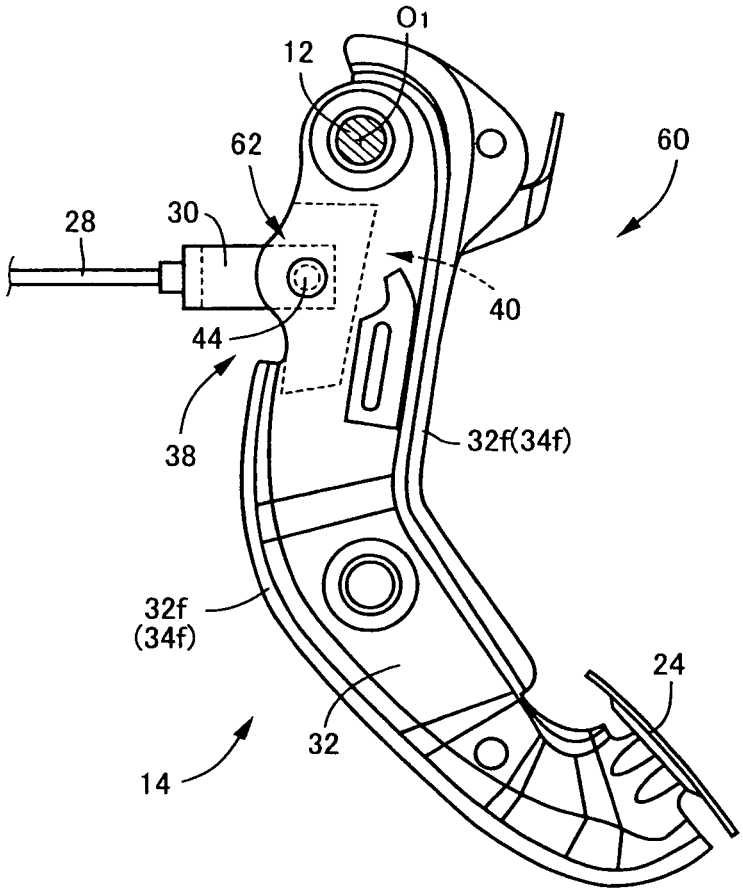
FIG. 5 is a diagram showing another example of the present invention.
Figure 6A:
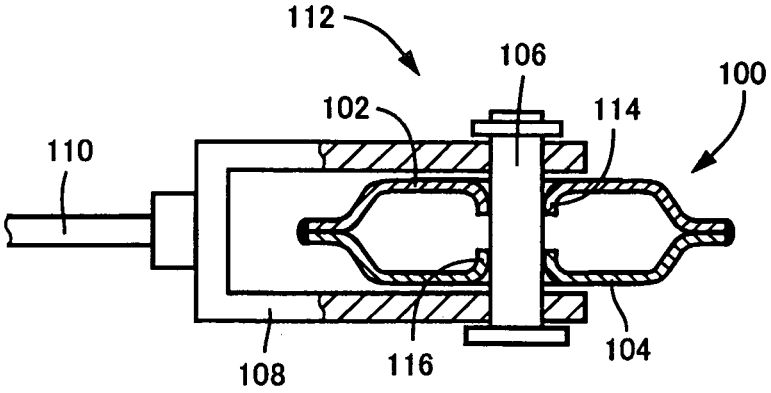
FIG.6A Prior Art
FIGS. 6A and 6B are sectional views explaining a conventional example of a pivotally connecting portion in case where a reaction force member is directly connected to an operating pedal.
Figure 6B:
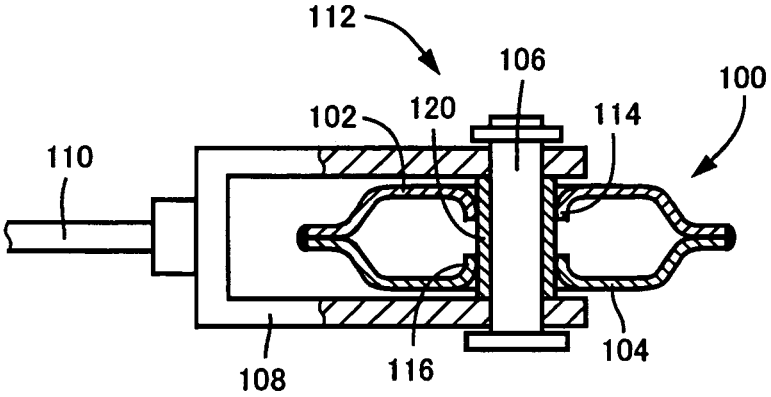
FIG.6B Prior Art

The above example explains an application of the invention to a link-style brake pedal device 10, in which the intermediate lever 18 is mounted on the vehicular front side of the operating pedal 14 pivotablly about the axis $O_2$ of the intermediate shaft 16 axis that is parallel to the axis $O_1$ of the supporting shaft 12, and the intermediate lever 18 is connected to the operating pedal 14 through the connecting links 20. However, the invention may also be applied the case where a clevis 30 of a push rod 28 is directly connected relatively pivotablly to an operating pedal 14 like the brake pedal device 60 shown in FIG. 5. Specifically, a pivotally connecting portion 62 thereof may be designed to have same structure as that of the above-mentioned pivotally connecting portion 22. For example, the connecting opening portion 38 is provided to the pivotally connecting portion 62, and a reinforcing member 40 is integrally weld-joined thereto. Then, the clevis 30 is inserted inside a pair of side plate parts 40*a* and 40*b* of the reinforcing member 40, and connected to the operating pedal 14 through a first link pin 44 relatively pivotablly.

The above explains an example of the invention in detail based on the drawings; however, this is just one embodiment of the invention, and various modifications and improvements are possible based on the knowledge of those skilled in the art.

What is claimed is:

1. An operating pedal device for a vehicle operated by a driver, the operating pedal device comprising:

a pedal support fixed to the vehicle;

an operating pedal mounted on the pedal support pivotably about a supporting axis and depressed by the driver;

a reaction force member transmitting an operation force of the operating pedal and acting a reaction force corresponding to the operation force; and a pivotally connecting portion disposed between the reaction force member and the operating pedal or between a transmitting member transmitting the operation force to the reaction force member and the operating pedal, and connecting the reaction force member to the operating pedal or the transmitting member to the operating pedal relatively pivotably about a connecting pin parallel to the supporting axis to transmit the operation force through the connecting pin, the operating pedal having a substantially hollow and closed structure as a whole and further including:

a connecting opening portion formed at a portion that is an outer periphery portion of the operating pedal and is connected to the reaction force member or the transmitting member through the pivotally connecting portion, and formed with a pair of side plate parts of the operating pedal being spaced apart in a predetermined dimension in a direction parallel to the supporting axis;

a reinforcing member having a U-shaped section mounted inside the connecting opening portion, opening edges of the reinforcing member and opening edges of the connecting opening portion both having a substantially same shape such that the opening edges of the reinforcing member coincide with the opening edges of the connecting opening portion so that the opening edges of the reinforcing member and the opening edges of the connecting opening portion are integrally welded to each other and the reinforcing member is integrally joined to the operating pedal blocking the connecting opening portion in such a manner that an opening of the U-shaped section faces outward, and a pair of side plate parts of the U-shaped section overlap the pair of side plate parts of the connecting opening portion, and forming a closed section in the operating pedal; and a pair of connecting holes formed in a straight line parallel to the supporting axis so as to pass through the pair of side plate parts of the reinforcing member and the pair of side plate parts of the connecting opening portion which are superposed at portions where the reinforcing member and the connecting opening portion are overlapped, and the connecting pin is mounted through both of the pair of connecting holes formed on the side plate parts respectively, such that the operation force is transmitted between the operating pedal and the connecting pin at least through the reinforcing member and joining portions between the pair of side plate parts of the U-shaped section and the pair of side plate parts of the connecting opening portion.

2. The operating pedal device for a vehicle according to claim 1, wherein the operating pedal is formed of a pair of half-divided bodies divided in the vehicle width direction and has a hollow structure formed by an integral joining, in a superposing manner, of plate-shaped flanges that are provided at outer circumferential portions of the pair of half-divided bodies and are parallel to each other; and the pair of side plate parts of the connecting opening portion are formed of substantially parallel plate portions of the pair of half-divided bodies, which are provided with no flanges and spaced apart from each other.

3. The operating pedal device for a vehicle according to claim 1, wherein an end portion of the reaction force member or the transmitting member on the side connected to the operating pedal is inserted inside the pair of side plate parts of the reinforcing member, and the connecting pin passes through the end portion and the pair of side plate parts, whereby the reaction force member or the transmitting member is pivotably connected relative to the operating pedal.

4. The operating pedal device for a vehicle according to claim 1, further comprising an intermediate lever mounted on the pedal support in the vehicular front side of the operating pedal pivotably about an intermediate axis parallel to the supporting axis, connected to the operating pedal through connecting links and mechanically pivoted about the intermediate axis in accordance with a depressing operation of the operating pedal, thereby transmitting an operation force to the reaction force member, and wherein:

a connecting portion between the connecting links and the operating pedal serves as the pivotally connecting portion;

the connecting links serve as the transmitting member, the pair of connecting links are mounted so that the pair of connecting links put the intermediate lever between the pair of connecting links;

end portions of the connecting links on the operating pedal side are inserted inside the pair of side plate parts of the reinforcing member, and the connecting pin passes through the end portions, whereby the pair of connecting links are pivotably connected relative to the operating pedal.

5. The operating pedal device for a vehicle according to claim 1, wherein an operation force is transmitted between the operating pedal and the connecting pin through the joining portions where a head of the connecting pin is integrally joined to one of the pair of side plate parts of the connecting opening portion.

6. The operating pedal device for a vehicle according to claim 2, wherein a lower end portion of the reinforcing member mounted on the connecting opening portion overlaps, in a predetermined dimension, a joining portion where a pair of flanges in a vehicular front side of the operating pedal are integrally joined.

7. The operating pedal device for a vehicle according to claim 4, wherein when the operating pedal is depressed and pivots toward the vehicular front side, the intermediate lever enters inside the connecting opening portion.

* * * * *